United States Patent [19]

Delaney et al.

[11] Patent Number: 4,957,382

[45] Date of Patent: Sep. 18, 1990

[54] PLATEN-YOKE APPARATUS FOR A PRINTER USING A FLOATING PLATEN

[75] Inventors: Robert Delaney, Kettering; Richard A. Merriman, Jr., Dayton, both of Ohio

[73] Assignee: NCR Corporation, Dayton, Ohio

[21] Appl. No.: 446,942

[22] Filed: Dec. 6, 1989

[51] Int. Cl.[5] ..... B41J 11/08

[52] U.S. Cl. ..... 400/656; 400/649; 400/58

[58] Field of Search ..... 400/55-58, 400/649, 656

[56] References Cited

U.S. PATENT DOCUMENTS

| | | | |
|---|---|---|---|
| 4,010,838 | 3/1977 | Sims, Jr. | 400/496 |
| 4,143,977 | 3/1979 | Kurihara et al. | 400/56 |
| 4,184,780 | 1/1980 | Kurihara et al. | 400/56 |
| 4,676,675 | 6/1987 | Suzuki et al. | 400/56 |
| 4,893,949 | 1/1990 | Limberger et al. | 400/56 |

FOREIGN PATENT DOCUMENTS

| | | | |
|---|---|---|---|
| 225981 | 12/1984 | Japan | 400/55 |
| 60-4082 | 1/1985 | Japan | 400/656 |

OTHER PUBLICATIONS

IBM Technical Disclosure Bulletin vol. 20 No. 11A 4/78.

*Primary Examiner*—Edgar S. Burr
*Assistant Examiner*—Ren Yan
*Attorney, Agent, or Firm*—Wilbert Hawk, Jr.; Albert L. Sessler, Jr.; Elmer Wargo

[57] ABSTRACT

A platen-yoke apparatus for a printer using a "floating platen". The platen for a wire matrix printer is mounted in a U-shaped channel. When the printer is moved to one side of a document feeding surface, a ramp on one end of the platen cooperates with a roller secured to the print head to depress that end of the platen to cause it to be moved below the feeding surface. A yoke member pivotally secured to the underside of the feeding surface and coupled to the ends of the platen causes the platen to be moved parallel to the feeding surface to lower the platen below the feeding surface to facilitate the insertion of a document to a printing station associated with the printer.

12 Claims, 3 Drawing Sheets

PLATEN-YOKE APPARATUS FOR A PRINTER USING A FLOATING PLATEN

BACKGROUND OF THE INVENTION (1) Field of the Invention

This invention relates to a platen-yoke apparatus for a printer using a "floating platen".

(2) Background Information

In certain printers which are used in financial systems, for example, it is necessary for the printer to be able to print on media having varying thicknesses. This is one example in which a printer having a "floating platen" may be used.

In a typical application, the printer may consist of a print head which is mounted and fixed on a carriage which moves the print head along the length of the associated platen. In order to print on media of varying thicknesses, it is necessary that the distance between the print head and the media be kept constant; this is especially true when the print head is a thermal print head or a wire matrix print head.

In such a printer, the associated platen is resiliently biased towards the print head and is considered to be a "floating platen". When a "form" or "passbook" is to be inserted in the printer, the platen is deflected a certain distance away from the print head to accommodate the thickness of the particular record medium being inserted therein. Thereafter, the resilient biasing of the platen towards the print head is used to maintain a constant distance between the record medium and the print head.

One of the problems associated with printers which utilize a "floating platen", is that it is sometimes difficult to insert the media into the printer between the platen and the print head. This is because the platen is resiliently biased towards the print head and tends to close the distance or gap between the platen and the print head.

SUMMARY OF THE INVENTION

This invention obviates the problem mentioned in the previous paragraph in that it utilizes a yoke member which keeps the "floating platen" parallel to the associated media feeding path and also keeps it out of the way to enable media to be inserted between the print head and the platen.

In a preferred embodiment, the invention relates to an apparatus comprising:

a print station;

a support means for guiding media to be printed upon to said print station; said support means having a media feeding surface, a bottom surface, and also having an elongated slot therein at said print station;

a platen being dimensioned to fit into said elongated slot and having first and second end portions;

first and second resilient members positioned between said support means and said platen for resiliently moving said platen in a direction moving from said bottom surface toward said media feeding surface; and a yoke member coupled to said bottom surface and said first and second end portions of said platen so as to maintain said platen substantially parallel to said media feeding surface when one of said first and second end portions is moved towards said bottom surface against the bias of said first and second resilient members.

In another aspect of this invention, there is provided a printer comprising:

a print station;

a support means for guiding media to be printed upon to said print station; said support means having a media feeding surface, a bottom surface, and also having an elongated slot therein at said print station;

a platen being dimensioned to fit into said elongated slot and having first and second end portions;

a print head;

carriage means for moving said print head in operative relationship with said platen;

first and second resilient members positioned between said support means and said platen for resiliently moving said platen in a direction moving from said bottom surface toward said media feeding surface and said print head; and a yoke member coupled to said bottom surface and said first and second ends of said platen so as to maintain said platen substantially parallel to said media feeding surface when one of said first and second end portions is moved towards said bottom surface against the bias of said first and second resilient members;

one of said first and second end portions having a ramp thereon to coact with said carriage means to move said one of said first and second end portions with said ramp thereon towards said bottom surface as said carriage means with said print head thereon is moved towards said one of said first and second end portions with said ramp thereon.

This invention is inexpensive to produce and is simple to implement. These advantages, and others, will become more readily apparent upon reviewing the following description, claims and drawing.

DESCRIPTION OF THE PREFERRED EMBODIMENT

Figure 1:
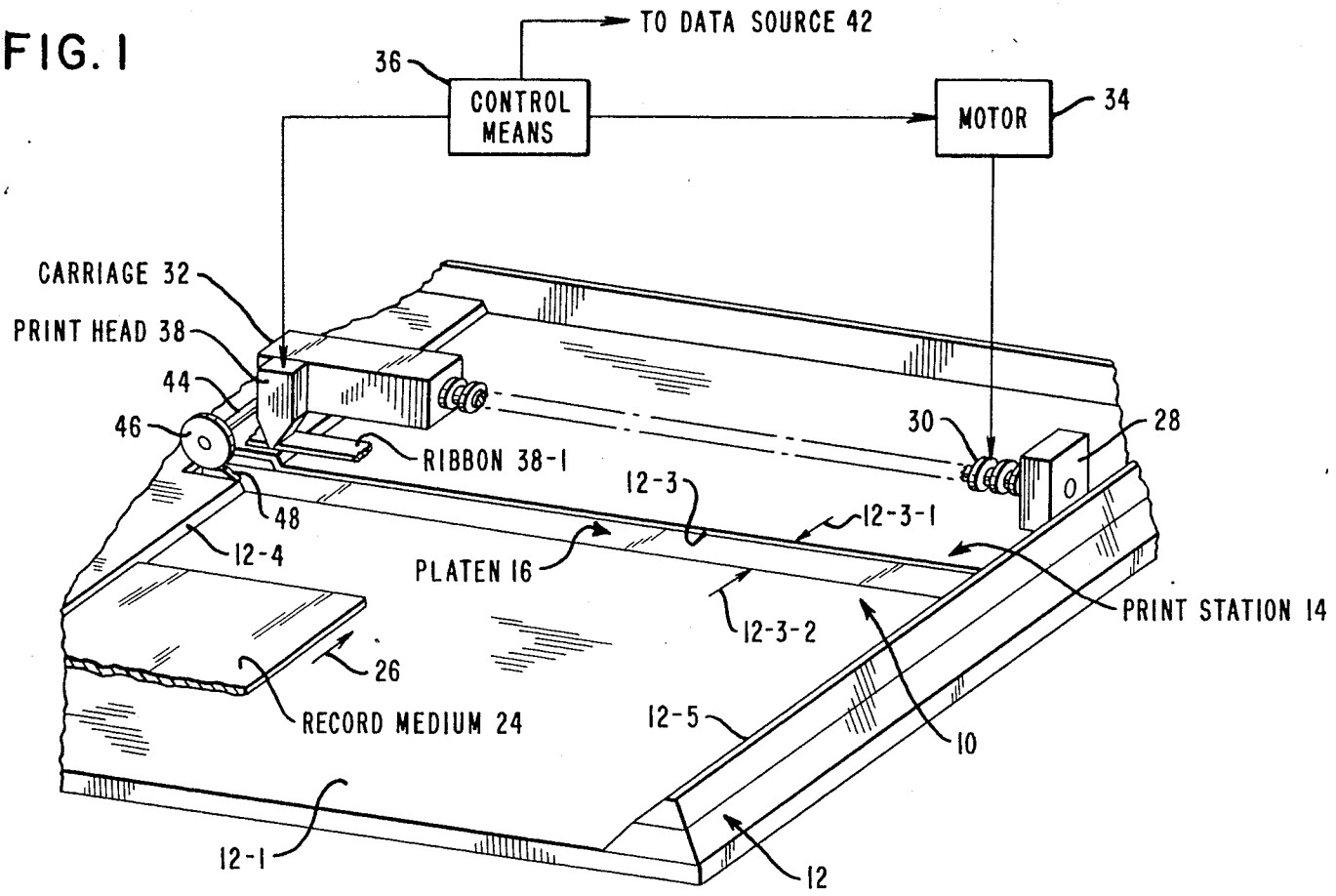
FIG. 1 is a general isometric view, shown partly in diagrammatic form, of a printer in which a preferred embodiment of the apparatus of this invention may be used. The printer includes a print station, a support means for guiding media to the print station, and a platen associated with the printer.
Figure 2:
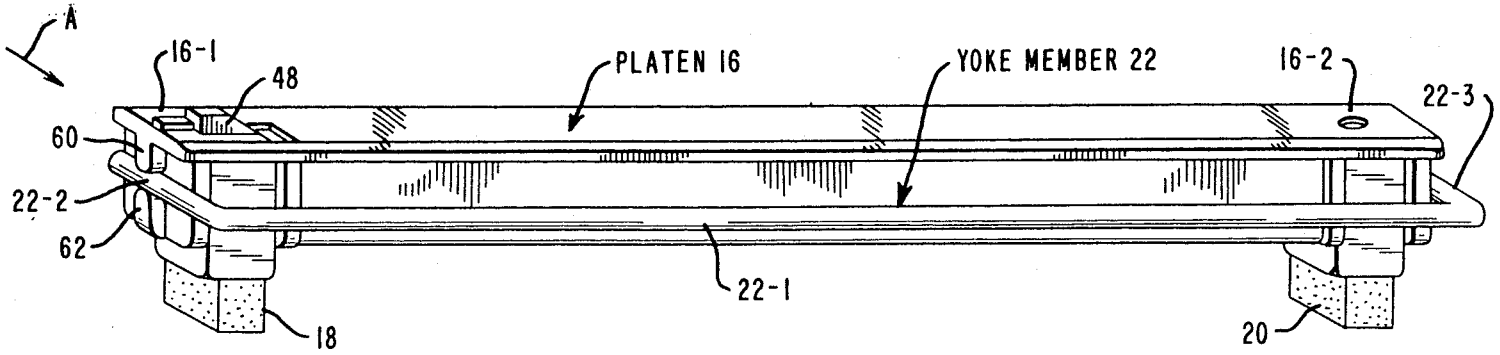
FIG. 2 is an isometric view of the platen (shown in FIG. 1) and a yoke member which are part of the apparatus of this invention.

FIG. 1 is a general isometric view, shown partially in diagrammatic form, of a printer in which a preferred embodiment or apparatus 10 of this invention may be used. In broad terms, the apparatus 10 includes a support means 12 for guiding media to be printed upon to a print station 14 and a platen 16. The apparatus 10 also includes certain elements not shown in FIG. 1. These elements (shown best in FIG. 2) include a first resilient member 18 positioned between a first end 16-1 of the platen 16 and the support means 12 and a second resilient member 20 correspondingly positioned between a second end 16-2 of the platen 16 and the support means 12. The apparatus 10 also includes a yoke member 22.

The support means 12 has a media feeding surface 12-1, a bottom surface 12-2 (FIG. 3) and an elongated slot 12-3 in which the platen 16 is mounted. The slot 12-3 is located at the print station 14 and it passes through the support means 12. The width of the slot 12-3 is shown by the arrows 12-3-1 and 12-3-2. The support means 12 also includes media guides 12-4 and 12-5 which are used for moving a record medium, like 24, in the direction of arrow 26 to the print station 14. The slot 12-3 is perpendicular to the media guides 12-4 and 12-5. The support means 12 also includes the usual supports, like support 28, for supporting one end of a traversing screw 30, with the other end of the traversing screw 30 being similarly supported; however, it is not shown.

The apparatus 10 also includes a carriage 32 (shown only diagrammatically in FIG. 1) which is mounted on the traversing screw 30, and is moved along the print station 14 by a motor 34. The motor 34 is bi-directional and is operatively coupled to the traversing screw 30 to rotate it in either direction under the control of a control means 36. A print head 38 (shown only diagrammatically in FIG. 1) is secured to the carriage 32 so as to: maintain a fixed relationship therebetween; maintain the print head 38 a fixed distance above the media feeding surface 12-1 of the support means 12; and maintain the print head 38 in operative relationship with the platen 16 as the print head 38 is moved along the length of the platen 16 by the carriage 32.

In the embodiment described, the print head 38 is a wire matrix printer having a single line of nine wire actuators (not shown) which are aligned parallel to the media guide 12-4, for example. The characters to be printed are developed as the print head 38 is traversed along the length of the platen 16. The particular wire actuators which are energized to complete a character are under the control of the control means 40 which receives its input from a data source 42. While the print head 38 is a wire matrix printer in the embodiment described, the principles of this invention may be extended to other printers, like thermal printers, for example. Because the print head 38, carriage 32, traversing screw 30, and the control means 36 are conventional, no additional discussion about these elements is deemed necessary.

The print head 38 (FIG. 1) also has shaft 44 extending therefrom, with the shaft 44 rotatably supporting a roller 46. The function of the roller 46 is to coact with a ramp 48 which is located on the first end 16-1 of the platen 16. When the print head 38 is moved to the extreme left, as viewed in FIG. 1, the roller 46 engages the ramp 48 to cam the first end 16-1 of the platen 16 in a downward direction as viewed in FIG. 1. This action, in conjunction with the action of the yoke member 22 (to be later described herein), moves the entire length of the platen 16 in the downward direction mentioned so that it is parallel to the media feeding surface 12-1 and slightly below it. With the platen 16 below the media feeding surface 12-1, a record medium 24, like a passbook, for example, may be inserted at the print station 14 without interference by the platen 16. In some prior art devices, one side of the platen 16 might be above the media feeding surface 12-1 so that it interfered with the insertion of the passbook or record medium 24. If a passbook (for keeping a record of bank deposits and withdrawals) were to be the thickest record medium 24 anticipated by the apparatus 10, then the fixed distance which the print head 38 is above the media feeding surface 12-1 would be slightly greater than the thickness of the passbook itself.

As alluded to in the Background Of The Invention, this invention relates to a platen-yoke apparatus for a printer using a "floating platen". In this regard, the platen 16 has the first end portion 16-1 and the second end portion 16-2, with these end portions being located at opposed ends of the platen 16 as shown best in FIG. 2. The first resilient member 18 is positioned between the first end portion 16-1 and the support means 12, and correspondingly, the second resilient member 20 is positioned between the second end portion 16-2 and the support means 12 to resiliently bias the platen 16 towards the print head 38. When the print head 38 is in the position shown in FIG. 1, the platen is kept slightly below the media feeding surface 12-1 as previously described. After a record medium 26 is inserted at the print station 14, the control means 36 energizes the motor 34 in the appropriate direction to move the carriage 32 and print head 38 to the right of the position shown in FIG. 1. When this occurs, the roller 46 moves off the ramp 48, permitting the first and second resilient members 18 and 20 to resiliently bias the platen 16 towards the print head 38. When this occurs, the platen 16 may be considered as "floating" relative to the print head 38. When so floating, a proper distance between the print head 38 and the record medium 24 is maintained so as to effect proper printing.

As previously alluded to, the first and second resilient members 18 and 20 are positioned between the platen 16 and the support means 12. In this regard, the support means 12 has wells 54 and 56 (FIG. 3) to receive the first and second resilient members 18 and 20, respectively. The first and second resilient members 18 and 20 may be made out of foam rubber, for example, or they may be made of compression type coil springs which may be positioned in mating recesses (not shown) in the first and second end portions 16-1 and 16-2 of the platen 16. The wells 54 and 56 mentioned are part of a U-shaped channel 58 which is dimensioned to receive the platen 16 to enable it to move towards and away from the print head 38. In the embodiment described, the platen 16 is quadrilaterally shaped, has a rectangular steel bar for a center (to provide rigidity along the length of the platen 16) and is coated with conventional plastic material to provide a resilient impact surface for the associated print head 38. The U-shaped channel 58 extends along the length of the platen 16; however, it is broken away in FIG. 3 to show additional details of the platen 16.

Figure 4:
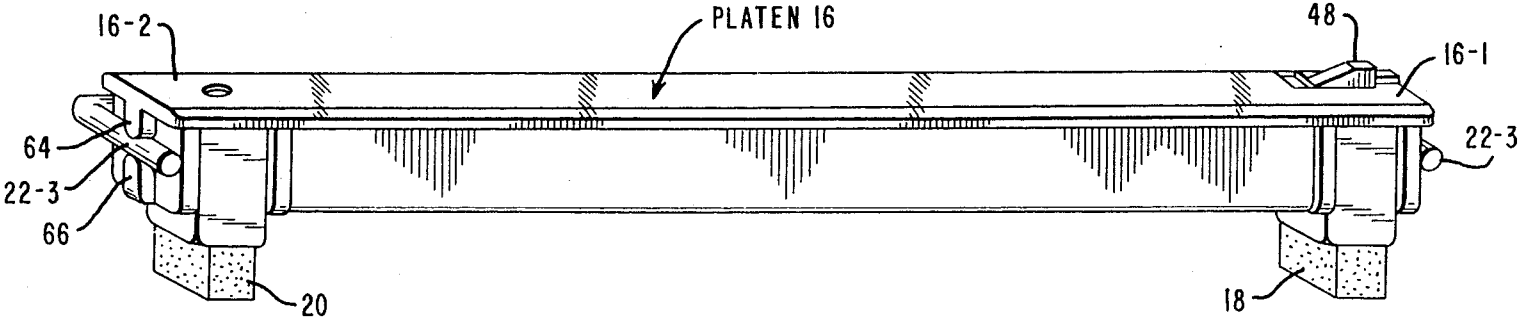
FIG. 4 (shown on the sheet containing FIG. 2) is an isometric view of the platen and yoke member shown in FIG. 2, and is taken from the direction of arrow A shown in FIG. 2.

The yoke member 22 (FIG. 2), alluded to previously herein, has a central portion 22-1 and end portions 22-2 and 22-3 which extend at substantially right angles to the central portion 22-1 to form a generally U-shaped member. The platen 16 has first and second projections 60 and 62, respectively, extending from the first end portion 16-1 of the platen 16, and correspondingly, the second end portion 16-2 of the platen 16 has third and fourth projections 64 and 66 (FIG. 4), respectively, extending therefrom. When the yoke member 22 is coupled to the platen 16, the first end portion 22-2 of the yoke member 22 is positioned between the first and second projections 60 and 62, and the second end portion 22-3 is positioned between the third and fourth projections 64 and 66 of the platen 16. The U-shaped channel 58 has a first slot 68 (FIG. 3) therein to receive the first end portion 22-2 of the yoke member 22, and correspondingly, the U-shaped channel 22 has a second slot 70 therein to receive the second end portion 22-3 of the yoke member 22.

Figure 3:
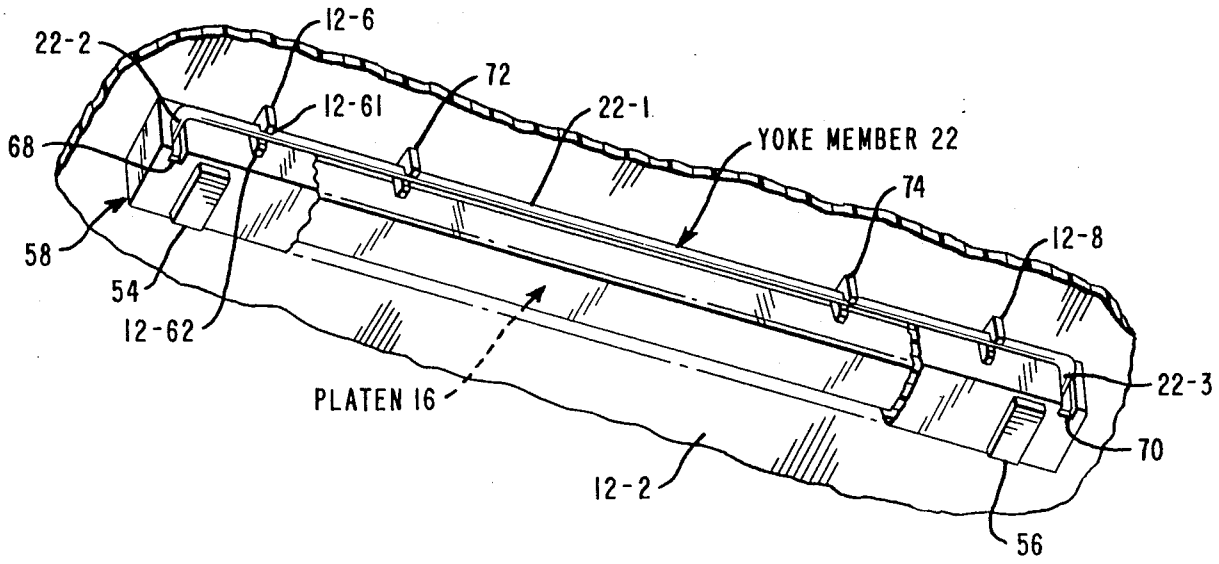
FIG. 3 is an isometric view of the underside of the support means shown in FIG. 1, and it also shows the platen and yoke member shown in FIG. 2.

The yoke member 22 (which is made of steel) is supported on the bottom surface 12-2 of the support means 12 by first and second support members 12-6 and 12-8 shown best in FIG. 3. The support means 12 is made of a tough resilient plastic material, and the support members 12-6 and 12-8 depend from the bottom surface 12-2 as mentioned. Each of the support members 12-6 and 12-8 is slotted to produce the ends 12-61 and 12-62 (shown for support member 12-6) which can be resiliently biased away from each other to permit the central portion 22-1 of the yoke member 22 to pass therethrough, and each of these support members has an opening (not numbered) therein which is shaped to receive and retain the diameter of the central portion 22-1 therein.

To assemble the apparatus 10, the first and second resilient members 18 and 20 are placed in the wells 54 and 56 (FIG. 3), respectively, and then the platen 16 is placed in the U-shaped channel 58. From the underside of the support means 12, the first end portion 22-2 of the yoke member 22 is inserted through the slot 68 and is positioned between the first and second projections 60 and 62 on the first end portion 16-1 of the platen 16. Correspondingly, the second end portion 22-3 of the yoke member 22 is inserted through the slot 70 and is positioned between the third and fourth projections 64 and 66 on the second end portion 16-2 of the platen 16. Thereafter, the center portion 22-1 of the yoke member 22 is pushed into the support members 12-6 and 12-8. When the apparatus 10 is assembled as described, the upper end of the slot 68 and the upper end of the slot 70 (as viewed in FIG. 3) limit the extent of travel of the platen 16 in moving towards and beyond the print head 38; however, there is sufficient movement of the platen 16 to handle the range of documents anticipated by the apparatus 10.

With the apparatus 10 assembled as described, and with the print head 38 moved to the left, as viewed in FIG. 1, the roller 46 engages the ramp 48 to depress the left side or the first end portion 16-1 of the platen 16. As this is done, the first end portion 16-1 of the platen 16 pivots the first end portion 22-2 of the yoke member 22 in a counter-clockwise direction as viewed in FIG. 3. The first end portion 22-2 functions as a "crank" at this time. When the yoke member 22 is so rotated, the second end portion 16-2 of the platen 16 is also depressed or moved away from the print head 38 so as to keep the platen 16 parallel to the media feeding surface 12-1 and to keep the platen 16 below this surface. With the platen 16 so positioned, a record medium 26 may be freely inserted at the print station 14.

In some situations, it may be desirable to employ more than the two support members 12-6 and 12-8 shown in FIG. 3. For example support members 72 and 74 may be added as shown in dashed outline. When this is done, support member 12-6 may be used to restrain movement of the yoke member 22 away from the print head 38 and support member 72 may be used to restrain movement of the yoke member 22 towards the print head 38. The support members 12-8 and 74 would function in the same manner as the support members 12-6 and 72, respectively.

Another advantage of the apparatus 10 is that the resilient members 18 and 20 (FIG. 2) deflect at the same time. This produces a constant force between the roller 46 and carriage 32 combination and the platen 16 along the length of the platen 16. The constant force mentioned improves print quality and reduces the chance of fatigue failure in the apparatus 10. In prior art printers without the yoke member 22, the associated springs supporting the platen deflect individually with the result that force between the platen and associated print head is not constant.

What is claimed is:

1. An apparatus comprising:

a print station;

a support means for guiding media to be printed upon to said print station; said support means having a media feeding surface, a bottom surface, and also having an elongated slot therein at said print station;

a platen being dimensioned to fit into said elongated slot and having first and second end portions;

first and second resilient members positioned between said support means and said platen for resiliently moving said platen in a direction moving from said bottom surface toward said media feeding surface; and a yoke member coupled to said bottom surface and said first and second end portions of said platen so as to maintain said platen substantially parallel to said media feeding surface when one of said first and second end portions is moved towards said bottom surface against the bias of said first and second resilient members.

2. The apparatus as claimed in claim 1 in which said platen is generally quadrilateral in cross section, and in which said platen has a ramp on one of said first and second end portions to facilitate moving said platen towards said bottom surface against the bias of said first and second resilient members.

3. The apparatus as claimed in claim 2 in which said ramp is dimensioned to enable said platen to be moved towards said bottom surface to enable a record of said media to be moved to said print station without interference by said platen.

4. An apparatus comprising:

a print station;

a support means for guiding media to be printed upon to said print station; said support means having a media feeding surface, a bottom surface, and also having an elongated slot therein at said print station;

a platen being dimensioned to fit into said elongated slot and having first and second end portions; said platen having first and second projections extending from said first end portion and third and fourth projections extending from said second end portion;

first and second resilient members positioned between said support means and said platen for resiliently moving said platen in a direction moving from said bottom surface toward said media feeding surface;

said bottom surface of said support means having first and second support members extending therefrom; and a generally U-shaped member having a central portion and first and second ends extending from said central portion; said central portion being mounted in said first and second support members, said first end being positioned between said first and second projections on said platen, and said second end being positioned between said third and fourth projections on said platen;

said apparatus being effective to maintain said second end portion of said platen below said media feeding surface when said first end portion of said platen is moved below said media feeding surface so as to facilitate the feeding of a document to said print station.

5. The apparatus as claimed in claim 4 in which said platen is generally quadrilateral in cross section, and in which said platen has a ramp on one of said first and second end portions to facilitate moving said platen towards said bottom surface against the bias of said first and second resilient members.

6. The apparatus as claimed in claim 5 in which said ramp is dimensioned to enable said platen to be moved towards said bottom surface to enable a record of said media to be moved to said print station without interference by said platen.

7. The apparatus as claimed in claim 4 in which said first and second support members are positioned on one side of said slot and are positioned between the ends of said slot.

8. The apparatus as claimed in claim 7 in which said support means includes first and second wells which are secured to said bottom surface to receive said first and second resilient members, respectively, and said first and second resilient members are made of plastic foam material.

9. The apparatus as claimed in claim 7 in which said first and second support members are shaped to enable said central portion of said generally U-shaped member to pivot therein as said first end portion of said platen is moved below said media feeding surface.

10. A printer comprising:

a print station;

a support means for guiding media to be printed upon to said print station; said support means having a media feeding surface, a bottom surface, and also having an elongated slot therein at said print station;

a platen being dimensioned to fit into said elongated slot and having first and second end portions;

a print head;

carriage means for moving said print head in operative relationship with said platen;

first and second resilient members positioned between said support means and said platen for resiliently moving said platen in a direction moving from said bottom surface toward said media feeding surface and said print head; and a yoke member coupled to said bottom surface and said first and second ends of said platen so as to maintain said platen substantially parallel to said media feeding surface when one of said first and second end portions is moved towards said bottom surface against the bias of said first and second resilient members;

one of said first and second end portions having a ramp thereon to coact with said carriage means to move said one of said first and second end portions with said ramp thereon towards said bottom surface as said carriage means with said print head thereon is moved towards said one of said first and second end portions with said ramp thereon.

11. The printer as claimed in claim 10 in which said bottom surface of said support means has first and second support members extending therefrom; said platen has first and second projections extending from said first end portion and third and fourth projections extending from said second end portion; and in which said yoke member is a generally U-shaped member having a central portion and first and second ends extending from said central portion; said central portion being mounted in said first and second support members, said first end being positioned between said first and second projections on said platen, and said second end being positioned between said third and fourth projections on said platen.

12. The printer as claimed in claim 11 in which said carriage means moves said print head in a direction which is parallel to the long dimension of said elongated slot.

* * * * *